United States Patent [19]

Levine et al.

[11] Patent Number: 4,759,498

[45] Date of Patent: Jul. 26, 1988

[54] THERMOSTATIC CONTROL WITHOUT TEMPERATURE DROOP USING DUTY CYCLE CONTROL

[75] Inventors: Michael R. Levine, Ann Arbor, Mich.; Lorne Nelson, Bloomington; Thomas Beckey, Edina, both of Minn.; James Russo, Ann Arbor, Mich.

[73] Assignee: Honeywell Inc., Minneapolis, Minn.

[21] Appl. No.: 96,963

[22] Filed: Sep. 15, 1987

Related U.S. Application Data

[63] Continuation-in-part of Ser. No. 70,725, Jul. 7, 1987.

[51] Int. Cl.[4] ..... F23N 5/20

[52] U.S. Cl. ..... 236/46 R; 165/12

[58] Field of Search ..... 236/46 R; 165/12; 62/231; 364/557

[56] References Cited

U.S. PATENT DOCUMENTS

| | | | |
|---|---|---|---|
| 4,292,813 | 10/1981 | Paddock | 165/12 X |
| 4,460,123 | 7/1984 | Beverly | 236/46 R |
| 4,509,585 | 4/1985 | Carney et al. | 165/12 |
| 4,694,890 | 9/1987 | Zarate | 165/12 |

*Primary Examiner*—William E. Wayner

*Attorney, Agent, or Firm*—Krass and Young

[57] ABSTRACT

The present invention is a technique for thermostatic control of a temperature modifying apparatus such as a heating unit or an air conditioning unit. This technique involves measuring the ambient temperature, generating an error signal based upon the difference between a set point temperature and the measured ambient temperature, operating the temperature modifying apparatus according to the error signal, and adjusting the set point temperature based upon the time history of the error signal. In accordance with the preferred embodiment of the present invention, the temperature modifying apparatus is operated during the next cycle interval with a duty cycle proportional to the error signal at the start of the cycle interval. In the preferred embodiment the set point is adjusted via an adjustment quantity which is increased if the difference between a desired temperature is of one sense decreased if the difference is of the opposite sense and maintained unchanged if the desired temperature equals the measured temperature, with the adjustment quantity maintained within a predetermined band.

38 Claims, 7 Drawing Sheets

THERMOSTATIC CONTROL WITHOUT TEMPERATURE DROOP USING DUTY CYCLE CONTROL

CROSS REFERENCE TO RELATED APPLICATION

The present application is a continuation-in-part of U.S. Patent Application Ser. No. 70,725, filed July 7, 1987.

FIELD OF THE INVENTION

The field of the present invention is that of electronic thermostats.

BACKGROUND OF THE INVENTION

There have heretofore been proposed a number of different types of apparatus for thermostatic control of a temperature modifying apparatus. The object of such a thermostatic control apparatus is to keep the temperature within an enclosed space at a specified point or within a specified range. It is desirable to keep the temperature within such a specified range with the minimum expenditure of energy.

The most common form of control in the prior art thermostat is on/off set point control. In this type of thermostat the temperature modifying apparatus is turned on when the measured temperature has one relation to a set point temperature and the temperature modifying apparatus is turned off when the measured temperature has another relationship to the set point temperature. Usually this type of control include a dead zone. In the case of control of a heating unit, the heating unit is turned on when the measured temperature is below a first temperature and turned off when the measured temperature is above a second higher temperature. Control of an air conditioning unit employs the opposite strategy.

The first thermostats employed bimetal strips. These bimetal strips are formed of layers of two metals having differing coefficients of expansion due to changes in temperature. They thus have differing curvatures depending upon temperature. Such bimetal strips were employed to control an on/off switch based upon their curvature. The set point temperature of such a thermostat is entered manually by positioning the bimetal sensing strip.

The typical thermostat of this type included an anticipator function. When heating, for example, it is known that the ambient temperature continues to rise after the heating unit is switched off. This occurs because of the latent heat in the heating unit which has not yet been transported to the space to be controlled. Operating the heating unit until the ambient temperature exceeds a particular temperature will result in an overshoot of this temperature. A particularly advantageous manner of providing this anticipator function is a resistance heater which is switched on when the heating unit is switched on by the thermostat. Using such a heater the temperature measured by the bimetal strip rises faster than the ambient temperature resulting in the heating unit being switched off sooner than otherwise, thereby anticipating the resulting continued rise in temperature after the heating unit is switched off. A similar phenomenon occurs for cooling. To provide an anticipate function for control of cooling the resistance heater is switched on when the air conditioner is switched off by the thermostat.

This form of anticipator has an additional advantage. The resistance heater forces the thermostat to cycle the controlled apparatus at a minimum rate regardless of temperature. This serves to reduce the temperature deviations of the control function. The particular location of the thermostat determines the temperature deviations that the thermostat experiences for identical operation of the controlled apparatus. A thermostat located very near a hot air duct will experience much greater temperature deviations than a thermostat located in a closet. While the control function will result in the same average temperature in both cases, the cycle rates and the temperature deviations will differ. The thermostat located near a hot air duct will cycle frequently and will provide short periods of activation of the heating unit with short off periods. This will permit relatively low temperature deviations from the set point. The thermostat located in a closet will cycle infrequently and will provide long periods of activation followed by long off periods. This will result in large temperature deviations from the set point during the cycle. By forcing the thermostat to cycle at a minimum rate the temperature deviations are kept within reasonable limits.

This forced cycling is preferably selected to provide the proper number of cycles for the particular temperature modifying apparatus. It is known in the art that differing temperature modifying apparatuses have differing desirable operation cycles. It is generally understood in the art that hot water heating units and air conditioning units operate best when run at three cycles per hour. For hot air heating units the optimum rate is generally understood as six cycles per hour. These assumed values take into account the minimum on and off times of the particular types.

Use of such an anticipator thermostat is not ideal. It is known in the thermostat art that there is a nearly linear relationship between the duty cycle of the temperature modifying apparatus and the difference between the actual average temperature and the set point temperature for these thermostats. This phenomenon is known as droop. In the case of heating the greater the thermal load on the heating unit the greater the duty cycle, the greater the heating effect by the anticipator resistance heater and the greater the difference between the set point temperature and the actual average temperature. For example, when the exterior temperature is coldest the actual average temperature is the furthest below the set point temperature. The same type of phenomenon occurs in the opposite sense for control of air conditioning. The average temperature is most nearly the set point temperature at low duty cycles approaching 0%, thus at low thermal loads. The maximum difference between the actual average temperature and the set point in these thermostats is approximately 3° F. at high duty cycles approaching 100% for these thermostats.

The typical reaction of a user to this situation leads to excess energy usage. In control of a heating unit, when the thermal load is greatest the user feels cold. At the same time the thermometer on the thermostat, which is also heated by the anticipator resistance heater, will tend to read the same as the set point. Most likely the user will raise the set point on the thermostat in order to compensate. This has the effect of raising the actual average temperature along with the set point to the range desired for comfort. This is fine for when the thermal load is high. However this has an undesirable effect when the thermal load decreases. When the thermal load is lessened the duty cycle is decreased and the difference between the set point temperature and the actual average temperature is decreased. This has the effect of maintaining a higher temperature than the minimum required for comfort, thereby unnecessarily increasing the energy usage. The user is unlikely to notice the difference and is unlikely to readjust the set point temperature when the thermal load changes. Thus excess energy usage occurs.

More recently thermostats have been constructed of electronic components. The use of a microprocessor enables more sophisticated control of temperatures. It is known in the art to enable the operator to specify a program of differing temperatures for differing times of the day, even for differing days of the week. The desired temperature or temperature range could thus be specified for greatest energy savings without sacrificing comfort. Such electronic thermostats still typically employ an on/off set point temperature control similar to the control strategy used in the bimetal strip thermostats with the desired temperature being changeable.

Typically such thermostats do not include an anticipator function but rely upon a hysteresis zone of temperatures. In the case of control of heating the thermostat will turn on the heating unit if the ambient temperature is lower than a first temperature and off if the ambient temperature is above a second higher temperature. In the zone between these two temperatures the thermostat may control the heating unit to be on or off depending upon the prior history. This causes the ambient temperature to swing between the two temperatures repeatedly crossing the hysteresis zone first while on and then while off.

This control function is good if the size of the hysteresis zone is matched to the temperature swings observed by the thermostat is its particular location. If the thermostat is in a lively location, such as in the direct flow path of air from a duct, then the hysteresis zone should be large to provide operation cycles having a reasonable rate for the particular temperature modifying apparatus controlled. Likewise a thermostat in an unlively location, such as in a closet, should be small because this location experiences small temperature swings. Typically such electronic thermostats do not provide an adjustment for the size of the hysteresis zone. In addition, even if such an adjustment were provided, it would be very difficult even for a knowledgable user to determine the proper adjustment. The such an adjustment would be beyond the understanding and capability of most users. Therefore such electronic thermostats provide a fixed hysteresis zone.

It would therefore be advantageous to provide a new type of thermostatic control strategy that would enable a better correlation between the desired temperature and actual average temperature over a wide range of thermal loads and provide a reasonable duty cycle for the temperature modifying apparatus regardless of the liveliness of the location of the thermostat.

SUMMARY OF THE INVENTION

The object of the present invention is to provide a manner of thermostatic control of a temperature modifying apparatus, such as a heating unit or an air conditioner, which is equally accurate over a wide range of thermal loads. Such a manner of thermostatic control would result in energy savings because it would no longer be necessary to manually change the set point temperature to compensate for droop during times of high thermal load.

This object is achieved by controlling the temperature modifying apparatus on a duty cycle basis. The relationship between the measured temperature and the desired temperature is measured. This relationship is translated into a corresponding duty cycle factor for an operation cycle. The temperature modifying apparatus is operated for a fraction of the next operation cycle, this fraction being set by the calculated duty cycle factor.

The calculation of the duty cycle factor is based upon the difference between the desired temperature and the measured ambient temperature. This difference is formed by subtracting the measured ambient temperature from the desired temperature for control of heating and subtracting the desired temperature from the measured ambient temperature for control of cooling. An additional adjustment quantity is added to this difference. This adjustment quantity is increased or decreased based upon the relationship of the desired temperature to the ambient temperature. In effect this automatically resets the set point temperature to achieve the desired temperature. This adjustment of the set point temperature occurs automatically in response to changes in the thermal load in a fashion to maintain the desired temperature.

In accordance with the preferred embodiment of the present invention, this manner of thermostatic control is achieved through the use of a programmed microprocessor device. Temperature is measured by measuring the resistance of a thermistor. The calculation of the duty cycle factor is performed via the computational capability of the microprocessor device. Alternatively the duty cycle factor calculation may be performed using the computational capability of microprocessor and a look up table. The microprocessor device also includes a clock which can indicate the passage of time. The microprocessor device employs the clock and the duty cycle factor to activate the temperature modifying apparatus for a fraction of an operation cycle corresponding to the calculated duty cycle factor. In accordance with the preferred embodiment of the present invention the operation cycle is twenty minutes long. In an alternative embodiment this operation cycle is ten minutes long.

The preferred embodiment of the present invention includes some refinements. Because the magnitude of the droop temperature is from 0° to 3°, the adjustment quantity is limited to that range. To avoid damage to the temperature modifying apparatus the preferred embodiment of the thermostatic control technique includes a minimum on time and a minimum off time. If the duty cycle factor would result in the temperature modifying apparatus being on for less than the minimum on time, then the temperature modifying apparatus is turned on for the minimum on time and then off for the rest of the operation cycle. Likewise if the duty cycle factor would result in the temperature modifying apparatus being off during the operation cycle for less than the minimum off time, then the temperature modifying apparatus is turned on for the length of the operational cycle less the minimum off time and then off for the minimum off time.

If the measured temperature is outside the control band afforded by adjustment of the adjustment quantity, then additional special provisions are made. In controlling a heating unit, if the measured temperature is above the control band then the heating unit is turned off while the temperature is continuously measured. The adjustment quantity may be decreased during this off time if the length of this off time is sufficiently large. The heating unit remains off until the measured temperature decreases sufficiently to require a minimum on time operation cycle. Likewise, if the measured temperature is below the control band the heating unit is turned on while continuously measuring the temperature. The adjustment quantity is increased during this on time if this on time is sufficiently long. When the measured temperature reaches the bottom of the control band the heating unit is turned off. The temperature is continuously measured until a peak temperature is reached. The measured ambient temperature will continue to rise after the heating unit is turned off due to latent heat in the heating unit which has not yet been transported to the controlled space. When the peak temperature is reached the duty cycle factor is calculated and a normal operation cycle follows. A similar process takes place with regard to control of air conditioning.

BRIEF DESCRIPTION OF THE DRAWINGS

These and other aspects of the present invention will become clear from study of the drawings in which.

DETAILED DESCRIPTION OF THE PREFERRED EMBODIMENT

Figure 1:
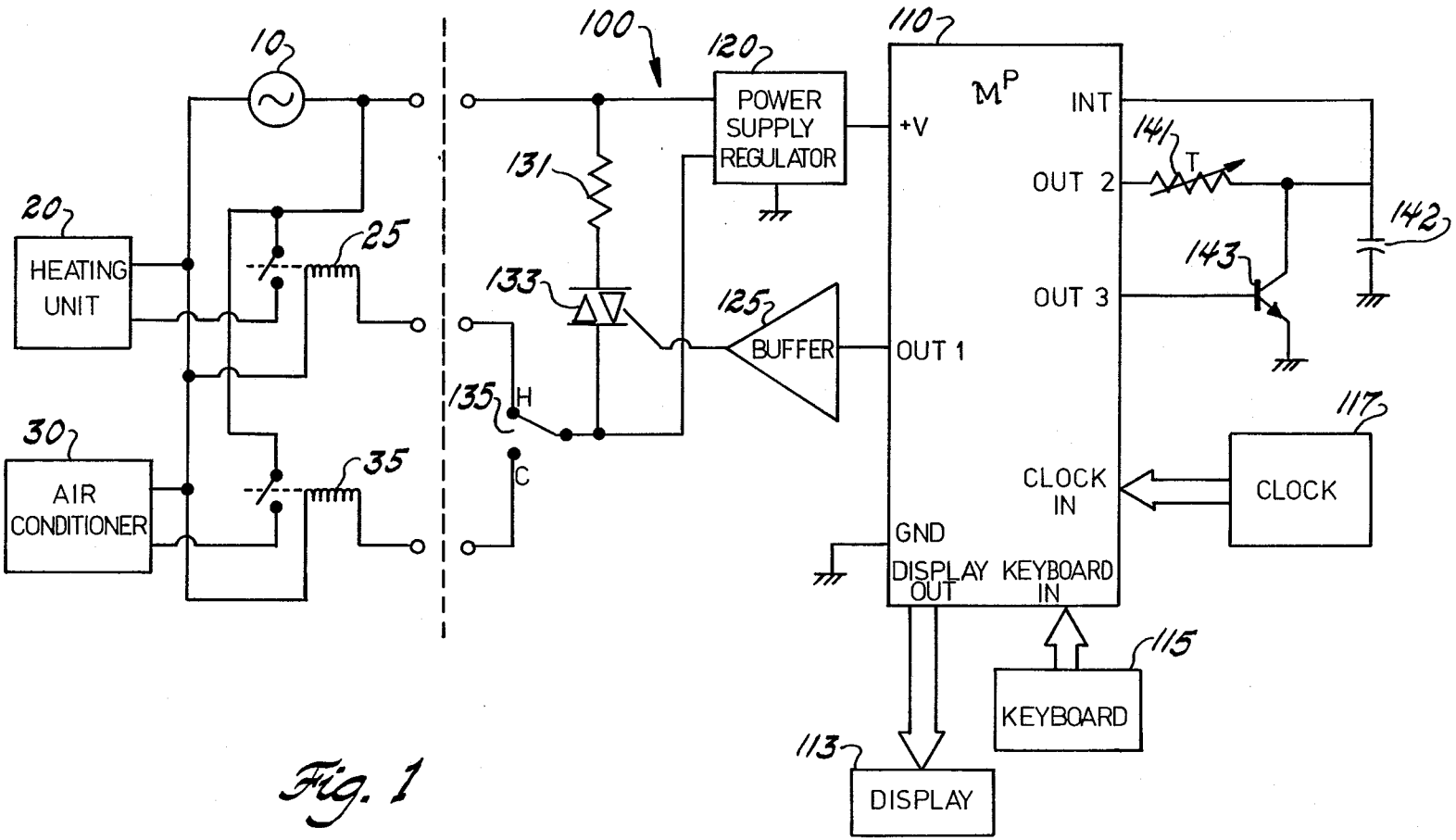
FIG. 1 illustrates an example of an electronic thermostat employing a microprocessor in accordance with the present invention.

FIG. 1 illustrates the construction of an electronic programmable thermostat in accordance with the present invention. Electronic programmable thermostat 100 includes microprocessor unit 110 which is coupled to display 113, keyboard 115 and clock 117, power supply regulator 120, a buffer 125 which drives a triac 133, a series resistor 131, a heat/cool mode switch 135 and a sensing circuit including thermistor 141, capacitor 142 and discharge transistor 143. Electronic thermostat 100 is connected to a combined heating and air conditioning plant including AC power supply 10, heating unit 20 with an associated relay 25 and air conditioner 30 with associated relay 35.

Microprocessor unit 110 is connected to display 113, keyboard 115 and clock 117 in conventional fashion. Display 113 is employed to display various quantities to the user. These quantities include the current ambient temperature, the desired temperature and the current time. In addition display 113 is employed to give feedback to the user when electronic thermostat 100 is programmed. Keyboard 115 is employed to receive operator input of all kinds. These inputs include the set point temperature, the length of the operation cycle and similar quantities. Microprocessor unit 110 is connected to clock 117. Clock 117 generates a signal indicative of the current time which is supplied to microprocessor unit 110. In the foregoing description of the invention many processes are time related, including the measurement of a time constant and the control of processes dependent upon elapsed time. Microprocessor unit 110 performs these functions in accordance with the signal indicative of the current time generated by clock 117.

Power supply regulator 120 is connected to receive power from the series connection of resistor 131 and triac 133. This power comes from AC power source 10. In the event that triac 133 is not triggered ON, then the full voltage of the AC power source 10 appears across the input to power supply regulator 120. Power supply regulator 120 does not draw sufficient current to permit tripping of either relay 25 or relay 35. If, on the other hand, triac 133 is triggered ON, then the voltage input to power supply regulator 120 is the voltage across triac 133 together with the IR voltage appearing across resistor 131. As a result, the input voltage applied to power supply regulator 120 varies widely depending on whether or not triac 133 is triggered ON. Therefore, power supply regulator 120 is employed to smooth these wide variations in supply voltage to derive the appropriate voltage for driving the microprocessor unit 110 and other parts of thermostat 100.

The ambient temperature is measured by the microprocessor unit 110 from thermistor 141, capacitor 142 and transistor 143. The resistance of thermistor 141 varies as a function of ambient temperature. Thermistor 141 together with capacitor 142 form a RC time constant circuit. The resistance of the thermistor 141 is measured by measuring the time constant of this RC circuit.

Transistor 143 is connected across capacitor 142. Transistor 143 has its base connected to output 2 of the microprocessor unit 110. Transistor 143 is employed to discharge any charge which is stored on capacitor 142. In response to a "1" output on output 3 from microprocessor unit 110, transistor 143 is biased ON and discharges any charge stored in capacitor 143. In response to a "0" output at output 3 of microprocessor unit 110, transistor 143 is biased OFF and does not effect the charge on capacitor 142.

Lastly, the output voltage across capacitor 142 is connected to an interrupt input of microprocessor unit 110. This interrupt input includes a Schmidt trigger device which rapidly turns on when a predetermined voltage is reached at this input. This interrupt input INT is employed to signal microprocessor unit 110 that the voltage across capacitor 142 has exceeded this predetermined value.

Measurement of the resistance of thermistor 141 occurs in the following manner. The time constant of the RC circuit including thermistor 141 and capacitor 142 is measured by microprocessor 110 by measuring the time to charge capacitor 142 to the threshold voltage of the interrupt input INT via thermistor 141. The elapsed time required for this charging corresponds to the resistance of thermistor 141. This in turn corresponds to the temperature at thermistor 141.

Figure 2:
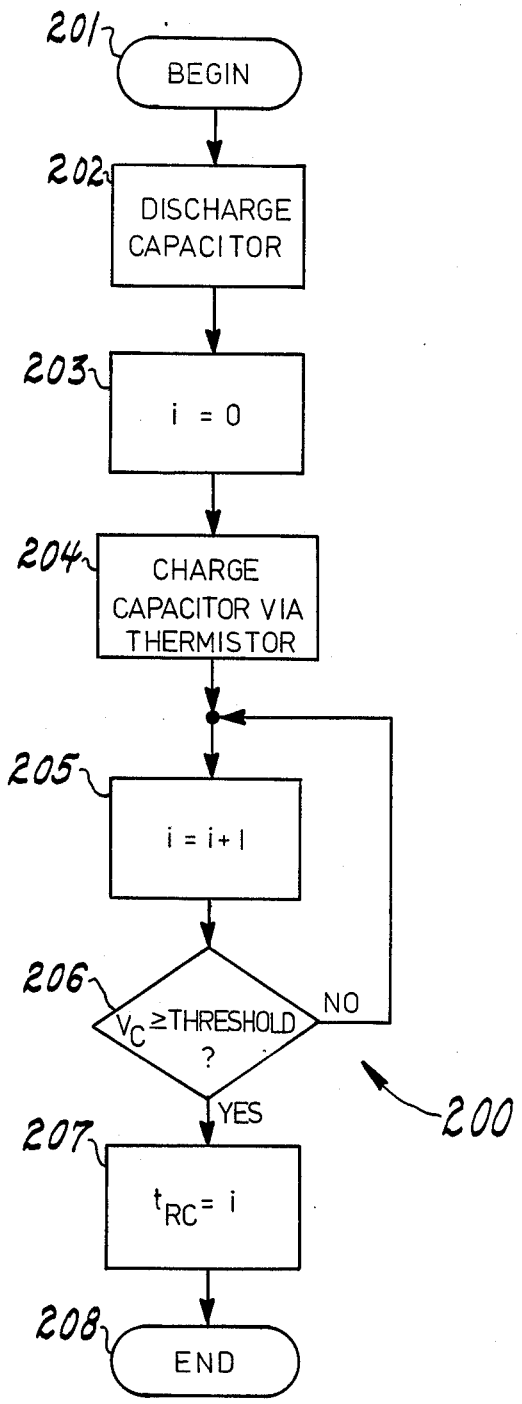
FIG. 2 illustrates an example of the subroutine for measuring the time constant of the thermistor RC circuit connected in the manner illustrated in FIG. 1.
Figure 3A:
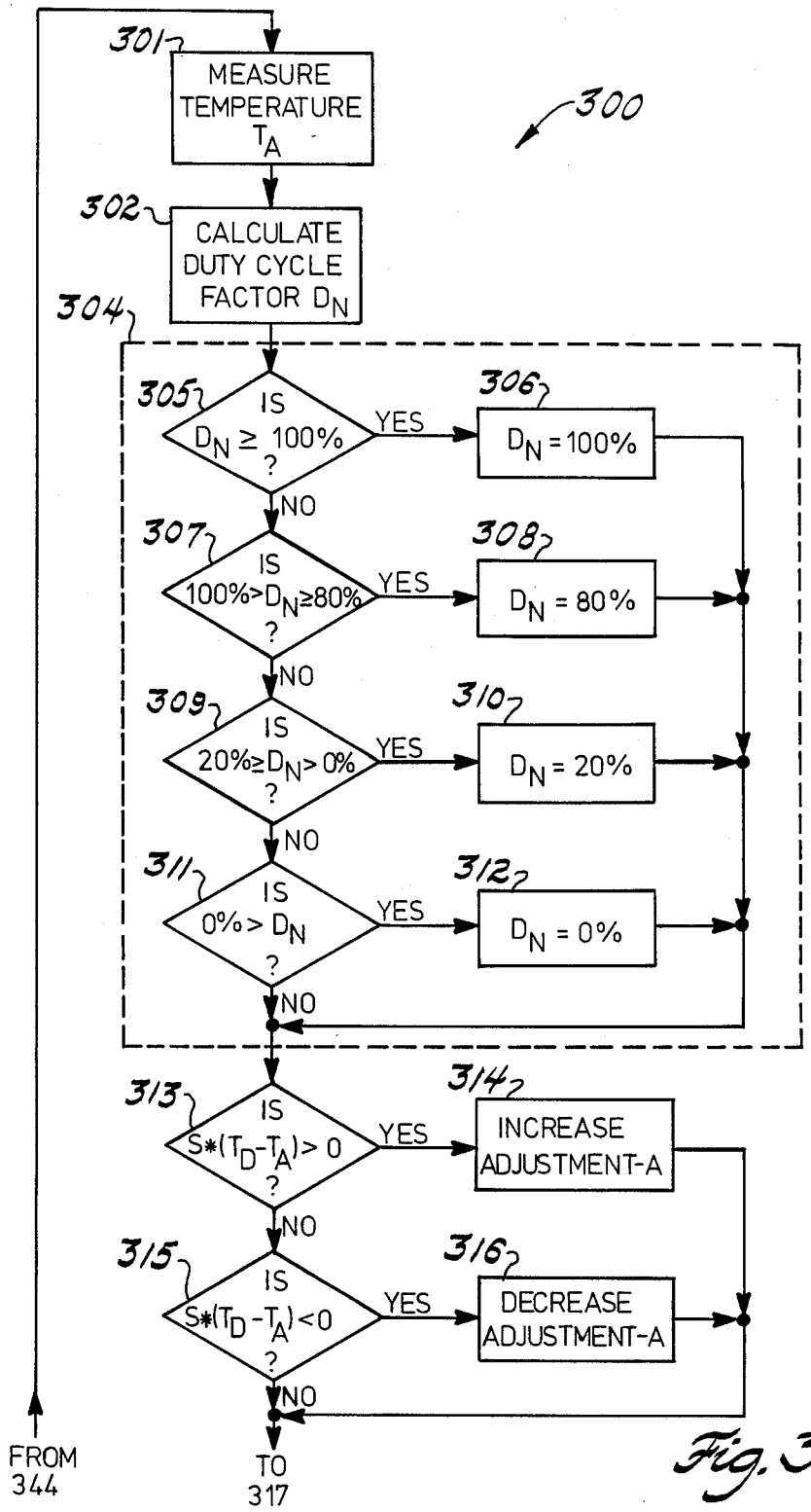
FIGS. 3*a*, 3*b*, 3*c* & 3*d* illustrate flow charts of a program for thermostatic control via control of the duty cycle of the temperature modifying apparatus in accordance with the present invention.
Figure 3B:
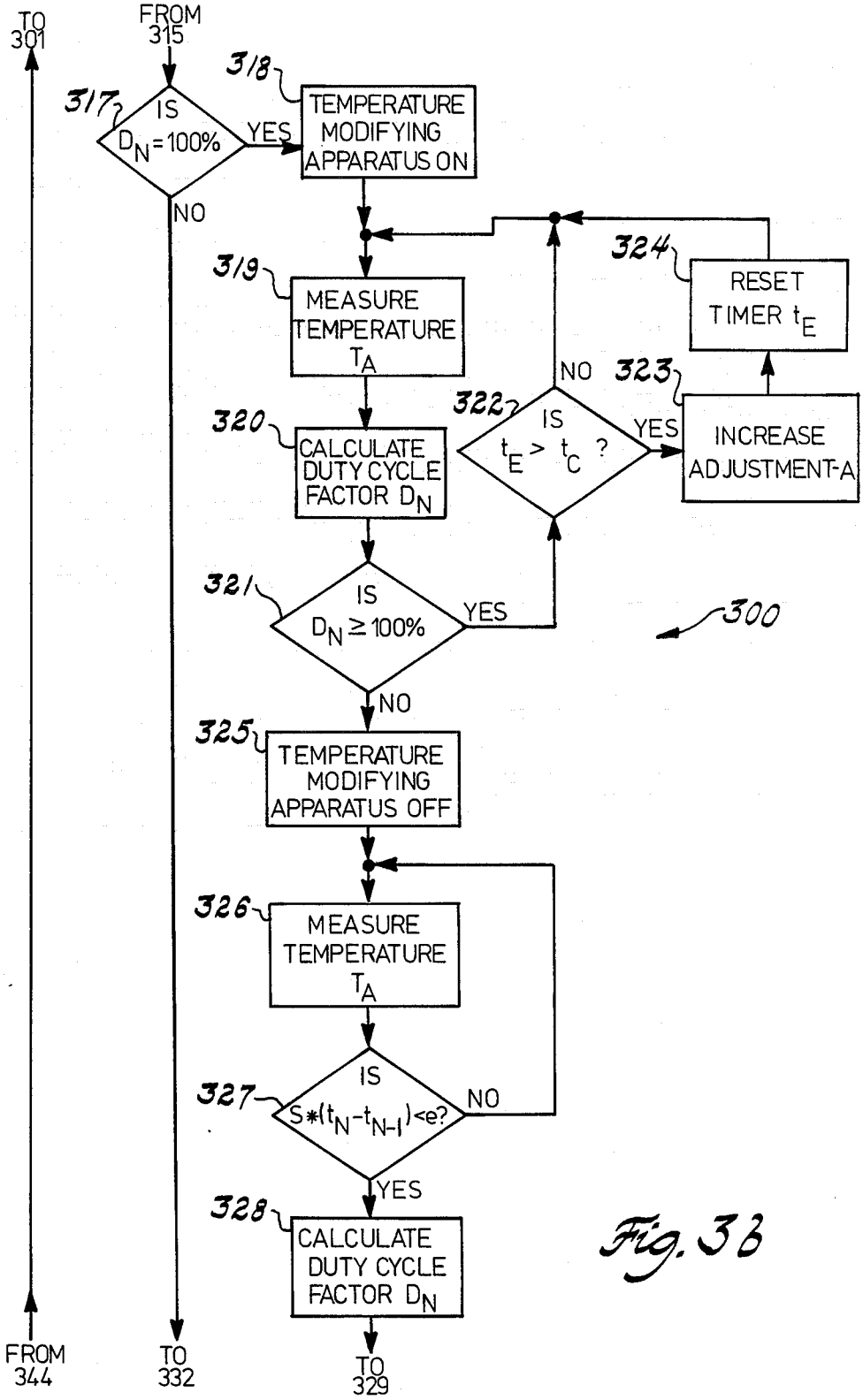
Figure 3C:
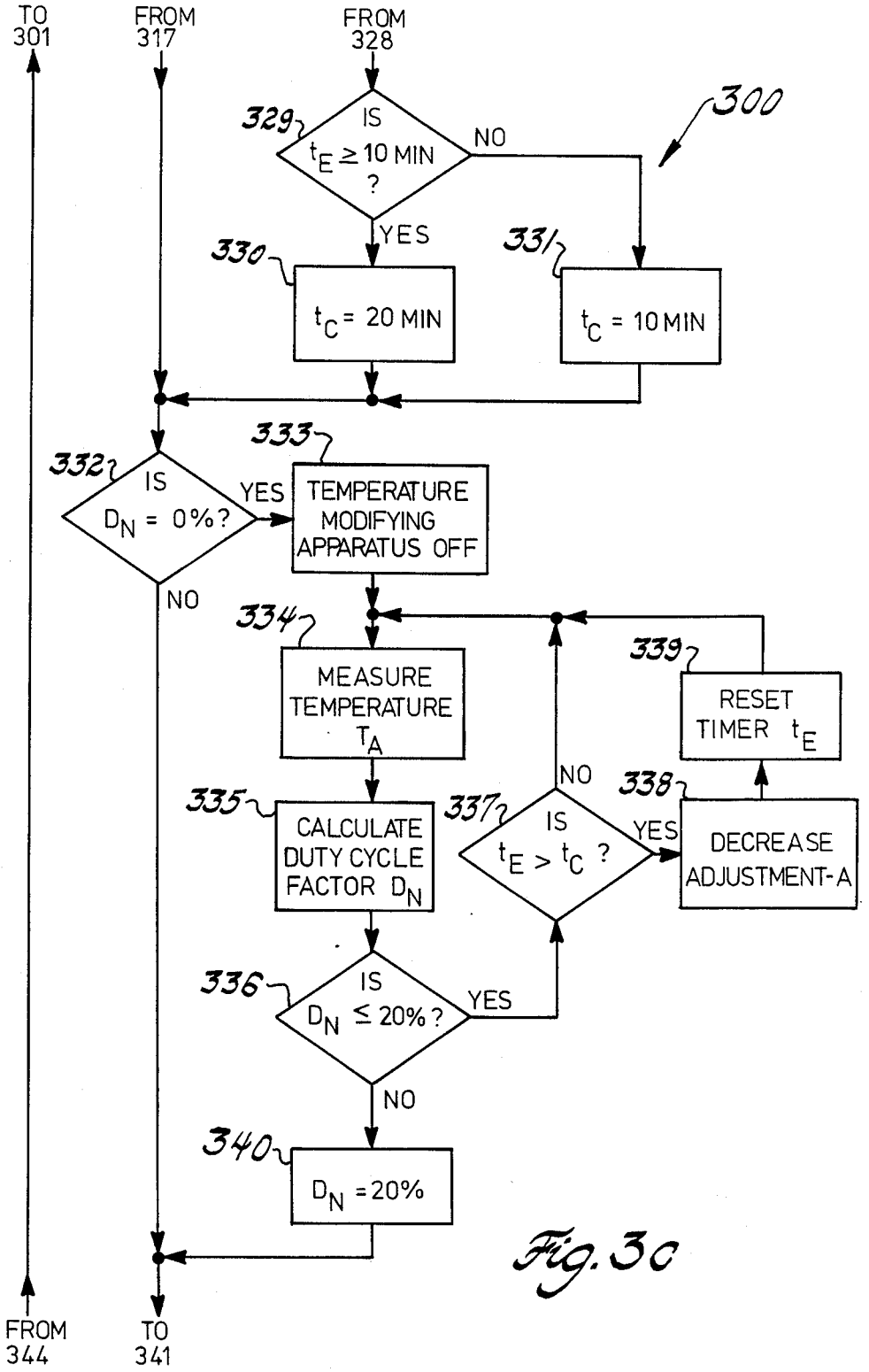
Figure 3D:
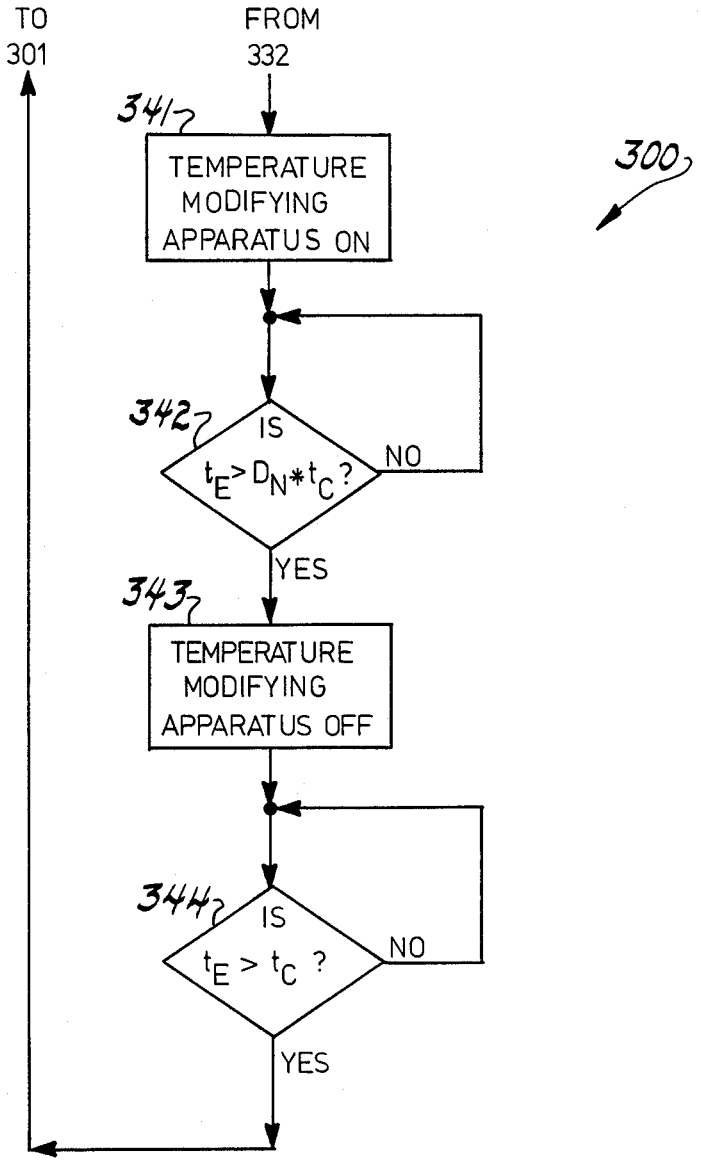

Program 200 illustrated in FIG. 2 is a flow chart of the manner in which the time constant of the RC circuit including thermistor 141 and capacitor 142 is measured. Program 200 is employed as a subroutine to embody processing blocks 301, 319, 326. and 334 illustrated in FIG. 3. Subroutine 200 is begun at start block 201. Subroutine 200 first discharge capacitor 142 (processing block 202). In the embodiment of the invention illustrated in FIG. 1 this takes place with the use of transistor 143. This function could alternatively take place by providing a "0" output on output 2 connected to thermistor 141. This latter technique requires a longer wait before it can be sure that capacitor 142 is completely discharged because the impedance of transistor 143 when on is much less than the impedance of thermistor 141. After capacitor 142 is discharged, subroutine 200 sets an index variable to 0 (processing block 203).

Subroutine 200 next charges capacitor 142 though thermistor 141 (processing block 204). This is achieved by setting output 2 connected to thermistor 141 to produce a "1" output. Subroutine 200 then increments the index variable i (processing block 205). Next, subroutine 200 tests to determine whether or not the voltage across capacitor 142 $V_C$ is greater than or equal to the threshold voltage (decision block 206). If this is not the case when the measurement is not complete and subroutine 200 returns to processing block 205. If this is the case then the measurement is complete. The measured time constant of thermistor 141 and capacitor 142 $t_{RC}$ is set equal to the index variable i (processing block 207). Subroutine 200 is then complete and is exited via end block 208.

In a practical embodiment of subroutine 200, the incrementing step 205 would be performed by adding 1 to a memory register within microprocessor unit 110. The processing of determining whether or not the voltage across the capacitor $V_C$ exceeds the predetermined threshold of decision block 206 can be employed via the interrupt input INT of microprocessor device 110. Thus the incrementing of the index variable i can occur within a closed loop and this loop be broken only at the receipt of the interrupt. The interrupt is detected when the voltage across the capacitor exceeds the predetermined threshold of the interrupt input INT. This interrupt signal stops the incrementing of the index variable i and causes this value to be stored as the measured time. Thus the clock which controls the rate of operation of the microprocessor device 110 serves as a timer to time the number of increments of the index variable i.

The temperature indicated by the resistance of thermistor 141 may be measured in other ways. Particular attention should be made to U.S. Pat. No. 4,206,872, issued June 10, 1980 to Michael R. Levine, one of the coinventors of the present invention. In that prior U.S. patent the temperature is measured using the thermistor in the tank circuit of a variable frequency osciallator. The variable frequency is measured to produce an indication of the temperature. This measurement technique could equally well be employed in the practice of the present invention.

The duty cycle control of a temperature modifying apparatus will now be described in conjunction with FIG. 3. FIG. 3 illustrates program 300 for control of microprocessor unit 110. This illustration is intended only to illustrate the general overall steps of the control process in accordance with the present invention. Upon selection of the particular type of microprocessor unit to use to embody the invention, one skilled in the art would be able to supply the exact details in accordance with the instruction set of the selected microprocessor unit.

Program 300 is a continuous loop which is employed to control the temperature modifying apparatus. Program 300 begins by measuring the temperature (processing block 301). This measurement takes place in accordance with the principles already described in conjunction with FIG. 2. The result of this measurement is the ambient temperature $T_A$.

Program 300 next calculates the new duty cycle factor $D_N$ (processing block 302). This calculation is performed using the computational capability of microprocessor unit 110 according to the following formula:

$$D_N=[A+S*(T_D-T_A)]*(100\%/B)$$

where $D_N$ is the new duty cycle factor, $T_D$ is the desired temperature, S is a sign factor which is 1 for control of a heating apparatus and −1 for control of an air conditioning apparatus, A is the adjustment quantity in degrees, $T_A$ is the measured ambient temperature, and B is the size of the control band in degrees. The sign factor S is selected by an operator input via keyboard 115. This input is necessary to inform microprocessor unit 110 whether a heating unit or an air conditioning unit is being controlled. The control band B is preferably preset in manufacture of the thermostat. In accordance with the preferred embodiment B is 3° F. to match the control band of the prior art thermostats described above.

The calculation of the duty cycle factor $D_N$ of processing block 302 may alternatively take place using a table look up operation. The sum of the adjustment quantity and the difference between the desired temperature and the measured ambient temperature is calculated. This sum references a look up table to find the duty cycle factor. This table look up operation serves to eliminate the need for microprocessor 110 to perform a multiplication. It is known in the microprocessor art that the type of microprocessors used to embody the present invention can more easily perform addition, subtraction and table look up operations than multiplication operations. Use of such a table look up operation would also be desirable if the relationship between the duty cycle of the temperature modifying apparatus and heat transported to the controlled space (or the heat removed from the controlled space in the case of cooling). is nonlinear. For example, many heating units will show a nonlinear relationship between time of operation and heat transported for short times of operation. This is due to the need to first raise the temperature of the heating unit before any heat can be transported. The look up table can be constructed with the appropriate relationship between time of operation and heat transfer so that there is a linear relationship between the temperature difference and the heat transferred. It should be understood, in light of the physical phenomenon represented, that there is a monotonic but not necessarily linear relationship between the temperature difference and the duty cycle factor reflected in the look up table.

Program 300 then enters subroutine 304 which adjusts the calculated duty cycle factor $D_N$. This adjustment takes place to control for out of control band situations and to provide a minimum on and off time for the temperature modifying apparatus. Firstly, if $D_N$ is greater than 100% (decision block 305) then $D_N$ is set to 100% (processing block 306). Since the temperature modifying apparatus is controlled based upon the duty cycle, a calculated duty cycle of greater than 100% cannot be realized. Program 300 next tests to determine if $D_N$ is between 80% to 100% (decision block 307). If this is true, then $D_N$ is set to 80% (processing block 308). As will be seen below, this provides the minimum off time for each operation cycle. Program 300 next tests to determine if $D_N$ is between 0% and 20% (decision block 309). If this is true, then $D_N$ is set to 20% (processing block 310) in order to provide the minimum on time for each operation cycle. Lastly, program 300 tests to determine if $D_N$ is less than 0% (decision block 311). This is another case in which the measured temperature is outside the control band. If this is true, then the $D_N$ is set to 0% (decision block 312). Note that in the case in which $D_N$ is between 20% and 80% subroutine 304 does not change $D_N$.

The program 300 next tests to determine whether any change is to be made in the adjustment quantity A. In accordance with the preferred embodiment the adjustment quantity A is changed based upon the relation of the desired temperature $T_D$ and the measured ambient temperature $T_A$. Program 300 first tests whether $S^*(T_D-T_A)$ is greater than zero (decision block 313). If this is true then the adjustment quantity A is increased (processing block 314). In accordance with the preferred embodiment adjustment quantity A is incremented by a predetermined amount of 5% of the permitted range B. The adjustment quantity A is not increased above B, thus A is unchanged if an increase above B is requested. If the test of decision block 313 is failed, then program 300 tests whether $S^*(T_D-T_A)$ is less than zero (decision block 315). If this is true then adjustment quantity A is decreased (processing block 316). This is preferably accomplished by decrementing adjustment quantity A by a predetermined amount equal to 5% of the range B. The adjustment quantity A is not decreased below 0°. If a decrease below 0° is requested, then adjustment quantity A is unchanged. Note that adjustment quantity A remains unchanged if the measured ambient temperature equals the desired temperature. The sign factor S used in the above tests insures adjustment quantity A is corrected in the proper direction for the alternative cases of control of heating and cooling. Any change in the adjustment quantity A will change the calculation of the duty cycle factor in the next loop of program 300.

The size of the increment or decrement to adjustment quantity A is set in relation to the length of the operation cycle to permit adjustment of the duty cycle as fast as the maximum expected rate of change of required duty cycle. As noted below, the adjustment quantity A corresponds to the duty cycle required to maintain the desired temperature. The worst case of expected rate of change of required duty cycle is expected to occur in control of air conditioning when the duty cycle can change from 0% at 8 AM to 100% at 3 PM. In the course of these seven hours there would be 21 twenty minute operation cycles. An increment or decrement of 5% of the control band B (or 0.15° F. in the preferred embodiment) is thus just adequate to make this duty cycle change. This figure sets the minimum required rate of change of adjustment quantity A. It is believed that this rate of change should be kept as small as possible to damp any oscillations in the control function.

After these processes, program 300 tests to determine whether the new duty cycle factor $D_N$ is equal to 100% (decision block 317). This could take place because of an increase in the thermal load which changes the ambient temperature to require a higher duty cycle, but is most likely to occur in the event that the desired temperature has changed.

If the calculated duty cycle factor $D_N$ is equal to 100%, then program 300 turns the temperature modifying apparatus on the resets the timer $t_E$ (processing block 318). Program 300 then repeats the measure of the temperature (processing block 319) and the calculation of the new duty cycle factor $D_N$ (processing block 320). Control of program 300 then goes to decision block 321 to test whether this new duty cycle factor $D_N$ is greater than or equal to 100%.

If the newly calculated duty cycle factor $D_N$ is greater than or equal to 100%, program 300 tests to determine if an elapsed time $t_E$ is greater than the length of the operation cycle $t_C$. If this is the case then the adjustment quantity A is increased (processing block 323). As noted above in relation to processing block 314 adjustment quantity A is not increased beyond 3°, the preferred size of the control band. This change in the adjustment quantity serves to alter the next calculation of the duty cycle factor. This change in adjustment quantity A is particularly useful when the required duty cycle has greatly increased due to a change in desired temperature, such as recovery from night set back. When controlling heating, recovery from night set back causes the air temperature to increase much faster than the temperature of the walls and furnishings. This differing rate of change of differing elements means that when the air temperature reaches the desired temperature the other elements have not yet reached the desired temperature. The lower temperature of these other elements places a greater thermal load upon the system than otherwise. This adjustment of adjustment quantity A serves to compensate for this additional thermal load.

After this increase in adjustment quantity A the elapsed timer is reset to begin the timing of an additional interval (processing block 324). Regardless of whether the elapsed time is greater than the length of the operation cycle, control returns to processing block 319 for another measurement of temperature.

This process serves to bring the temperature within the proper range for correct calculation of the duty cycle factor. If the above formula indicates the duty cycle needs to be more that 100%, naturally the best that can be achieved is a duty cycle of 100%. At the same time it is expected that such a situation would only arise if the desired temperature $T_D$ has been recently changed. In this event it may be necessary to keep the temperature modifying apparatus on for a long time in order to reach the desired temperature. The process described above insures that the temperature modifying apparatus is on for at least as long as necessary and to come within the control band.

After the temperature modifying apparatus has been on for long enough to bring the temperature into the control band (as evidenced by the calculated duty cycle factor being less than 100%), program 300 turns the temperature modifying apparatus off and resets the timer $t_E$ (processing block 325). The temperature is then measured (processing block 326). The temperature is then tested against the prior temperature (processing block 327). It is well known that a temperature modifying apparatus (either a heating unit or an air conditioning unit) has a latent heat that causes the temperature to drift in the direction promoted by the temperature modifying apparatus even after being turned off. The test of decision block 327 determines when this drift ends by detecting the change in direction of movement of temperature. The quantity e may be a small positive value, in which case the test of decision block 327 detects a point just before the change in direction of temperature movement, or it may be zero, which detects the point of change in direction of temperature movement. Note the change in direction of temperature movement is a peak when controlling heating and a trough when controlling cooling. The sign factor S is added to make this formula applicable to both heating and cooling cases. Once this change in temperature slope is detected the duty cycle factor $D_N$ is calculated (processing block 328). With this complete the special case is ended and control proceeds along the main program flow.

The process just described is included in the control function to provide damping. It is expected that a requirement for a duty cycle greater than or equal to 100% will most often occur due to a change in the desired temperature. In such a case the temperature modifying apparatus may be on for the equivalent of several operation cycles before the temperature enter the control band. If a cycle with the minimum off time were to be requested as soon as the temperature entered the control band, it is highly likely that the temperature modifying apparatus would move the temperature completely through the control band and the next cycle would call for a duty cycle of less than 0%. This control function has been included to avoid the possibility of such an overshoot. By waiting until the direction of motion of the temperature changes before calculating the duty cycle factor and beginning a normal operation cycle any such tendency is substantially reduced. Since the point where the direction of movement of temperature changes is an equilibrium point, it is expected that the duty cycle factor calculated at this point will be near to the true required duty cycle.

The next section of program 300, consisting of blocks 329, 330 and 331, provides an automatic determination of the length of the operation cycle. This section is optional and not necessary for operation of the present invention. In the case that this optional section is omitted the proper length of the operation cycle should be entered via a manual operation employing keyboard 115 under the control of microprocessor 110. Since such input operations are well known they will not be further described herein.

Decision block 329 tests to determine whether the elapsed time of the coasting period is greater than or equal to ten minutes. If this is the case, then it is expected that the thermostat 100 is controlling a hot water heating unit or an air conditioning unit. Therefore the length of the operation cycle is set to 20 minutes (processing block 330). If this length of time is less than ten minutes, then it is expected that the thermostat is controlling a hot air heating unit. Accordingly the length of the operation cycle is set to ten minutes (processing block 331). In either event program 300 continues.

Program 300 next performs a similar process for the case when the calculated duty cycle factor is equal to 0%. First program 300 tests to determine whether the new duty cycle $D_N$ is equal to 0% (decision block 332). If this is the case then the temperature modifying apparatus is turned off and the timer $t_E$ is reset (processing block 333). The temperature is measured (processing block 334) and the new duty cycle factor $D_N$ is calculated (processing block 335).

Program 300 then tests to determine whether or not the newly calculated duty cycle factor $D_N$ is less that or equal 20%. This test determines whether the calculated duty cycle factor $D_N$ calls for at least the minimum on time. If the newly calculated duty cycle factor $D_N$ is less than or equal to 20% (decision block 336), program 300 tests to determine if an elapsed time $t_E$ is greater than the length of the operation cycle $t_C$ (decision block 337). If this is the case then the adjustment quantity A is decreased (processing block 338). As noted above in relation to processing block 316 adjustment quantity A is not decreased below 0°. This change in the adjustment quantity serves to alter the next calculation of the duty cycle factor. This process is similar to that described with regard to increasing the adjustment quantity during operation when $D_N$ equals 100%. After this increase the elapsed timer is reset to begin the timing of an additional interval (processing block 339). Regardless of whether the elapsed time is greater than the length of the operation cycle, control returns to processing block 334 for another measurement of temperature.

This process serves the same purpose as explained above in regard to the test for a duty cycle factor equal to 100%. If the duty cycle factor calculated in this loop is less than 20%, these steps ensure the temperature modifying apparatus is off until the calculated duty cycle factor $D_N$ is sufficiently large to require operation of the temperature modifying apparatus for at least the minimum on time. This takes place by keeping the temperature modifying apparatus off until the ambient temperature causes the duty cycle factor calculation to satisfy this condition.

Once the temperature is within the desired range, the duty cycle factor $D_N$ is set to the minimum value, which is 20% in the preferred embodiment (processing block 340). It is not expected that there will be any extensive temperature drift in this case contrary to the case in which the temperature modifying apparatus was left on. Because no significant temperature drift is expected and the temperature has just entered the control band the provision of a minimum length cycle is appropriate.

At this point all the special cases have been taken into account. When control reaches this point program 300 then performs the duty cycle control of the length of time the temperature modifying apparatus is on during the operation cycle. Note that provision has already been made for the minimum on time and minimum off time. Because any duty cycle factors between 80% and 100% are set to 80% and any duty cycle factors between 0% and 20% are set to 20% (note description above in relation to subroutine 304), the following processes provide for minimum on time and the minimum off time.

Program 300 next turns the temperture modifying apparatus on and resets the timer $t_E$ (processing block 341). This is achieved by providing the proper output to buffer 125 to trigger triac 133 on. This serves to supply electric power to relay 25 or relay 35, whichever is selected by heat/cool switch mode 135. The selected relay then actuates the corresponding temperature modifying apparatus, either heating unit 20 or air conditioner 30. Program 300 then waits for the passage of a time period equal to the product of the duty cycle factor $D_N$ and the predetermined time period $t_C$ (decision block 342). Decision block 342 remains in a loop until the elapsed time $t_E$ exceeds the above product. During this time the temperature modifying apparatus remains on. This timing function takes place with reference to the clock signal from clock 117.

Once this interval has passed then the temperature modifying apparatus is turned off (processing block 343). Program 300 then waits for the elapsed time $t_E$ from the start of the cycle to exceed the predetermined time period $t_C$ (decision block 344). The temperature modifying apparatus remains off during this time. Once this occurs the loop is repeated with control of program 300 returning to processing block 301 for measurement of the parameters.

The thermostatic control of the present invention operates by direct control of the duty cycle of operation of the temperature modifying apparatus. When the measured ambient temperature $T_A$ differs from the desired temperature $T_D$, then adjustment quantity A is changed. In the event that $S(T_D-T_A)$ is greater than zero, the control equation is adjusted by incrementing the adjustment quantity A. This tends to require a higher duty cycle from the temperature modifying apparatus in line with the perceived thermal load. Likewise if $S^*T_D-T_A)$ is less than zero, then the adjustment quantity is decremented thus tending to require a lower duty cycle. The sign factor S is provided so that the adjustment made with the proper sign necessary for control of heating or cooling.

Figure 4:
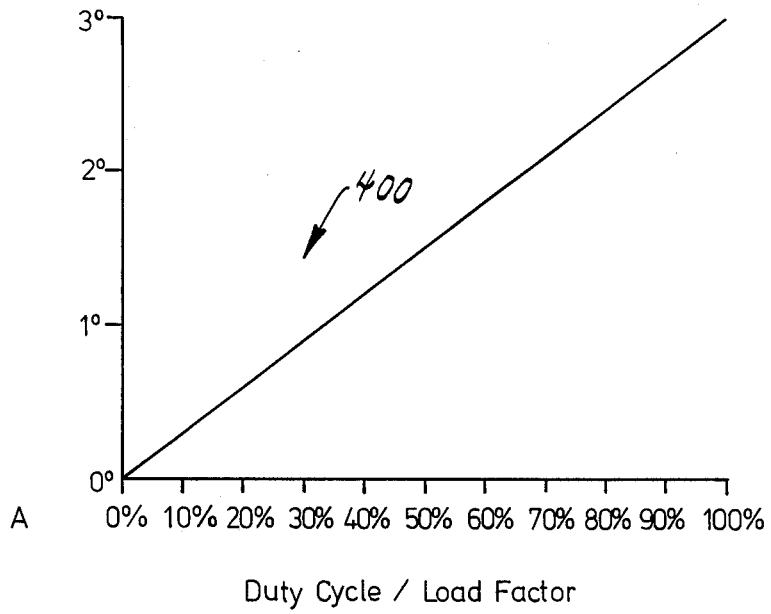
FIG. 4 illustrates the relationship between the average duty cycle of a temperature modifying apparatus and the adjustment quantity in accordance with the present invention.

The operation of this thermostatic control based upon the control of the duty cycle of the temperature modifying apparatus can be understood from a study of the equation $$D_N=[A+S^*(T_D-T_A)]^*(100\%/B)$$

which is used to calculate the new duty cycle $D_N$. The control goal is to have the measured ambient temperature $T_A$ equal to the desired temperature $T_D$. If this is achieved then the duty cycle factor $D_N$ is linearly related to the adjustment quantity A. This linear relationship is illustrated in FIG. 4. This linear relationship 400 between the duty cycle factor $D_N$ and the adjustment quantity A is the inverse of the known relationship between temperature droop and duty cycle for the prior art thermostats described above. The control process of calculating a new duty cycle factor $D_N$, comparing the desired temperature $T_D$ to the measured ambient temperature and adjusting the adjustment quantity A serves to change the adjustment quantity A to correspond to the duty factor needed to enable the temperature modifying apparatus to maintain the ambient temperature at the desired temperature.

Figure 5:
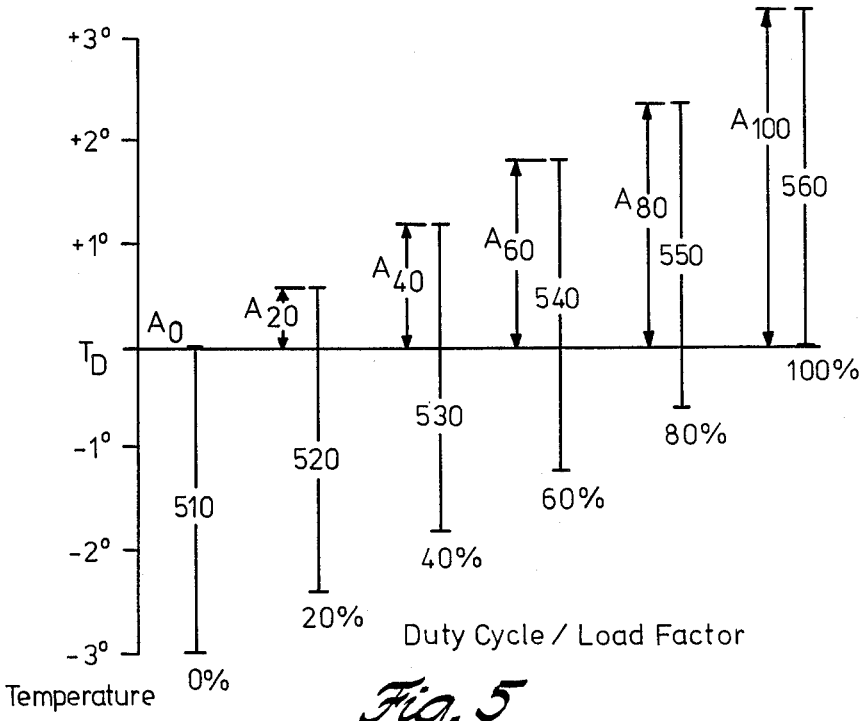
FIG. 5 illustrates the relationship between the adjustment quantity, the desired temperature and the duty cycle of the temperature modifying apparatus.

FIG. 5 illustrates the relationship between selected values of the adjustment quantity A and the control band in relation to the desired temperature for the case of control of a heating unit. When the adjustment quantity A is 0° F. (shown on FIG. 5 as $A_0$) the control band 510 is between three degrees below the desired temperature and the desired temperature. The thermostat would operate in this range only when the temperature load required a very small duty cycle approaching 0%. Any measured ambient temperature within this control band 510 would result in an accurate calculation of the new duty cycle. Likewise an adjustment quantity $A_{20}$ would result in a control band 520 between 2.4° F. below the desired temperature and 0.6° F. above the desired temperature. In a similar fashion an adjustment quantity $A_{40}$ results in a control band 530, adjustment quantity $A_{60}$ results in a control band 540, adjustment quantity $A_{80}$ has a corresponding control band 550 and adjustment quantity $A_{100}$ a corresponding control band 560. This adjustment of the control band through the adjustment quantity A serves to accurately compensate for the temperature droop observed in the prior art thermostats described above. The additional refinements in the control process described above in relation to FIG. 3 serve to provide protection to the temperature modifying apparatus (through the minimum on and off times) and cover pathological cases where the ambient temperature falls outside the control band.

The control function of the present invention can also be thought of as adjustment of the set point temperature. The equation for calculation of the duty cycle can be rearranged to show this. Note that $S^2=1$ regardless of whether the control is of heating or cooling. Therefore the duty cycle calculation can be expressed as:

$$D_N=S^*(T_S-T_A)^*(100\%/B)$$

where $T_S$ is the adjusted set point temperature equal to $T_D+S^*$ A. Hence any change in the adjustment quantity A is the same as alteration of the set point temperature $T_S$. The above relation shows that the control function of the present invention changes the set point based upon deviation from the prior set point. In the preferred embodiment the adjustment quantity A is changed slowly, by at the rate of 5% of the quantity B or 0.15° F. per operation cycle, in order to provide a damped control. This reduces wild swings in the set point while providing sufficient gain to settle upon the proper temperature in a reasonable period of time.

The above relation is the error function in the temperature control process. In general the error function according to the present invention can be expressed as:

$$E=(Q_S-Q_A)^*(A/B)$$

where E is the error signal, $Q_S$ is the set point quantity, $Q_A$ is the measured quantity, A is a constant of proportionality and B is the width of the control band expressed in terms of the quantity Q. Operation of the controlled apparatus is proportional to the error signal E, which in the present invention is based upon the duty cycle of operation of the temperature modifying apparatus. In addition the set point $Q_S$ is adjusted based upon the past history of the error signal. In the thermostat control embodiment described herein the past history of the error signal is measured by the difference between the current error signal and the error signal calculated at a predetermined prior time (the start of the previous operation cycle). This control technique serves to correct for any offset bias attributable to control based upon the error signal alone.

We claim:

1. A method of thermostatic control of a temperature modifying apparatus comprising the steps of:

measuring the ambient temperature;

calculating a new duty cycle factor for the temperature modifying apparatus based upon the difference between a desired temperature and the measured ambient temperature as modified by an adjustment quantity;

adjusting said adjustment quantity based upon the relationship of the desired temperature to the measured ambient temperature; and activating the temperature modifying apparatus for a portion of the next predetermined interval of time corresponding to said new duty cycle factor.

2. The method of thermostatic control of a temperature modifying apparatus as claimed in claim 1, wherein:

said new duty cycle factor is set according to the following formula $$D=[A+S^*(T_D-T_A)]^*(100\%/B)$$

where D is the new duty cycle factor, $T_D$ is the desired temperature, S is a sign factor which is 1 for control of a heating apparatus and −1 for control of an air conditioning apparatus, A is the adjustment quantity, $T_A$ is the measured ambient temperature and B is the width of a temperature control band.

3. The method of thermostatic control of a temperature modifying apparatus as claimed in claim 2, wherein:

said step of changing of the adjustment quantity includes increasing the adjustment quantity if $S^*(T_D-T_A)$ is greater than zero, decreasing the adjustment quantity if $S^*(T_D-T_A)$ is less than zero and maintaining the adjustment quantity unchanged if $S^*(T_D-T_A)$ equals zero.

4. The method of thermostatic control of temperature modifying apparatus as claimed in claim 3, wherein:

said step of changing the adjustment quantity does not increase said adjustment quantity to greater than B and does not decrease said adjustment quantity to less than 0 degrees.

5. The method of thermostatic control of a temperature modifying apparatus as claimed in claim 4, wherein:

said step of adjusting said adjustment quantity adjusts said adjustment quantity in increments of 5% of B per each predetermined interval of time.

6. The method of thermostatic control of a temperature modifying apparatus as claimed in claim 2, wherein:

said width of the temperature control band B is 3 degrees F.

7. The method of thermostatic control of a temperature modifying apparatus as claimed in claim 6, wherein:

said step of changing of the adjustment quantity includes increasing the adjustment quantity by 0.15 degrees but to no more than 3 degrees F if $S^*(T_D-T_A)$ is greater than zero, decreasing the adjustment quantity by 0.15 degrees but to no less than 0 degrees F if $S^*(T_D-T_A)$ is less than zero and maintaining the adjustment factor unchanged if $S^*(T_D-T_A)$ equals zero.

8. The method of thermostatic control of a temperature modifying apparatus as claimed in claim 2, wherein:

the temperature modifying apparatus is a hot water heating unit; and said predetermined interval of time is twenty minutes.

9. The method of thermostatic control of a temperature modifying apparatus as claimed in claim 2, wherein:

the temperature modifying apparatus is an air conditioning unit; and said predetermined interval of time is twenty minutes.

10. The method of thermostatic control of a temperature modifying apparatus as claimed in claim 2, wherein:

the temperature modifying apparatus is a hot air heating unit; and said predetermined interval of time is ten minutes.

11. The method of thermostatic control of a temperature modifying apparatus as claimed in claim 2, wherein:

said step of activating the temperature modifying apparatus for portion of said predetermined interval of time includes a minimum on time for the temperature modifying apparatus to be on if the duty cycle factor indicates the temperature modifying apparatus is to be on for less than said minimum on time.

12. The method of thermostatic control of a temperature modifying apparatus as claimed in claim 11, wherein:

said minimum on time is twenty percent of said predetermined interval of time.

13. The method of thermostatic control of a temperature modifying apparatus as claimed in claim 11, wherein:

said step of activating said temperature modifying apparatus includes, whenever said new duty cycle is calculated to be less than or equal to 0%, the steps of deactivating said temperature modifying apparatus, repeatedly measuring said ambient temperature and calculating a new duty cycle factor until said new duty cycle factor indicates said temperature modifying apparatus is to be on for said minimum on time, and thereafter activating said temperature modifying apparatus for said minimum on time during said next predetermined interval of time.

14. The method of thermostatic control of a temperature modifying apparatus as claimed in claim 13, wherein:

said step of adjusting said adjustment quantity decreases said adjustment quantity in increments of 5% of B for each predetermined interval of time which passes while said temperature modifying apparatus is deactivated whenever said new duty cycle is calculated to be less than or equal to 0%.

15. The method of thermostatic control of a temperature modifying apparatus as claimed in claim 2, wherein:

said step of activating the temperature modifying apparatus for portion of said predetermined interval of time includes a minimum off time for the temperature modifying apparatus to be off if the if the duty cycle factor indicates the temperature modifying apparatus is to be on for more than the predetermined interval of time less the minimum off time.

16. The method of thermostatic control of a temperature modifying apparatus as claimed in claim 15, wherein:

said minimum off time is twenty percent of said predetermined interval of time.

17. The method of thermostatic control of a temperature modifying apparatus as claimed in claim 2, wherein:

said step of activating said temperature modifying apparatus includes, whenever said new duty cycle is calculated to be greater than or equal to 100%, the steps of activating said temperature modifying apparatus, repeatedly measuring said ambient temperature and calculating a new duty cycle factor until said new duty cycle factor is less than 100%, thereafter deactivating said temperature modifying apparatus, repeatably measuring said ambient temperature until the direction of motion of the temperature changes, and thereafter calculating a new duty cycle factor and activating the temperature modifying apparatus for a portion of the next predetermined interval of time corresponding to said new duty cycle factor.

18. The method of thermostatic control of a temperature modifying apparatus as claimed in claim 17, wherein:

said step of adjusting said adjustment quantity increases said adjustment quantity in increments of 5% of B for each predetermined interval of time which passes while said temperature modifying apparatus is activated whenever said new duty cycle is calculated to be greater than or equal to 100%.

19. The method of thermostatic control of a temperature modifying apparatus as claimed in claim 2, wherein:

said keep of activating the temperature modifying apparatus for a portion of the next predetermined interval of time includes activating the temperature modifying apparatus for a period of time related to said new duty cycle factor and deactivating the temperature modifying apparatus for the remainder of the predetermined interval of time.

20. A apparatus for thermostatic control of a temperature modifying apparatus comprising:

a temperature measuring means for measuring the ambient temperature;

adjustment quantity memory means for storing an adjustment quantity;

duty cycle factor calculation means connected to said temperature measuring means and said adjustment quantity memory means for calculating a new duty cycle factor for the temperature modifying apparatus based upon the difference between a desired temperature and said measured ambient temperature as modified by an adjustment quantity;

adjustment quantity adjustment means connected to said temperature measuring means and said adjustment quantity memory means for changing said adjustment quantity based upon the relationship of the desired temperature to said measured ambient temperature; and control means connected to said duty cycle calculation means for activating the temperature modifying apparatus for a portion of the next predetermined interval of time corresponding to said new duty cycle factor.

21. The apparatus for thermostatic control of a temperature modifying apparatus as claimed in claim 20, wherein:

said duty cycle calculation means calculates said new duty cycle factor according to the formula $$D=[A+S^*(T_D-T_A)]^*(100\%/B)$$

where D is the new duty cycle factor, $T_D$ is the desired temperature, S is a sign factor which is 1 for control of a heating apparatus and −1 for control of an air conditioning apparatus, A is the adjustment quantity, $T_A$ is the measured ambient temperature and B is the width of a temperature control band.

22. The apparatus for thermostatic control of a temperature modifying apparatus as claimed in claim 21, wherein:

said adjustment quantity adjustment means adjusts said adjustment quantity by increasing the adjustment quantity if $S^*(T_D-T_A)$ is greater than zero, decreasing the adjustment quantity if $S^*(T_D-T_A)$ is less than zero and maintaining the adjustment quantity unchanged if $S^*(T_D-T_A)$ equals zero.

23. The apparatus for thermostatic control of temperature modifying apparatus as claimed in claim 22, wherein:

said adjustment quantity adjustment means does not increase said adjustment quantity to greater than B and does not decrease said adjustment quantity to less than 0 degrees.

24. The apparatus for thermostatic control of a temperature modifying apparatus as claimed in claim 23, wherein:

said adjustment quantity adjustment means adjusts said adjustment quantity in increments of 5% of B.

25. The apparatus for thermostatic control of a temperature modifying apparatus as claimed in claim 21, wherein:

said width of the temperature control band B is 3 degrees F.

26. The apparatus for thermostatic control of a temperature modifying apparatus as claimed in claim 25, wherein:

said adjustment quantity adjustment means includes means for increasing said adjustment quantity by 0.15 degrees but to no more than 3 degrees F. if $S^*(T_D-T_A)$ is greater than zero, decreasing said adjustment quantity by 0.15 degrees but to no less than 0 degrees F if $S^*(T_D-T_A)$ is less than zero and maintaining said adjustment factor unchanged if $S^*(T_D-T_A)$ equals zero.

27. The apparatus for thermostatic control of a temperature modifying apparatus as claimed in claim 21, wherein:

the temperature modifying apparatus is a hot water heating unit; and said predetermined interval of time is twenty minutes.

28. The apparatus for thermostatic control of a temperature modifying apparatus as claimed in claim 21, wherein:

the temperature modifying apparatus is an air conditioning unit; and said predetermined interval of time is twenty minutes.

29. The apparatus for thermostatic control of a temperature modifying apparatus as claimed in claim 21, wherein:

the temperature modifying apparatus is a hot air heating unit; and said predetermined interval of time is ten minutes.

30. The apparatus for thermostatic control of a temperature modifying apparatus as claimed in claim 21, wherein:

said control means includes means for activating the temperature modifying apparatus for at least a minimum on time for the temperature modifying apparatus to be on if the duty cycle factor indicates the temperature modifying apparatus is to be on for less than said minimum on time.

31. The apparatus for thermostatic control of a temperature modifying apparatus as claimed in claim 30, wherein:

said minimum on time is twenty percent of said predetermined interval of time.

32. The apparatus for thermostatic control of a temperature modifying apparatus as claimed in claim 30, wherein:

said control means further includes means for deactivating said temperature modifying apparatus, repeatedly measuring said ambient temperature and calculating a new duty cycle factor until said new duty cycle factor indicates said temperature modifying apparatus is to be on for said minimum on time, and thereafter activating said temperature modifying apparatus for said minimum on time during said next predetermined interval of time, whenever said new duty cycle is calculated to be less than or equal to 0%.

33. The apparatus for thermostatic control of a temperature modifying apparatus as claimed in claim 32, wherein:

said means for adjusting said adjustment quantity includes means for decreasing said adjustment quantity in increments of 5% of B for each predetermined interval of time which passes while said temperature modifying apparatus is deactivated whenever said new duty cycle is calculated to be less than or equal to 0%.

34. The apparatus for thermostatic control of a temperature modifying apparatus as claimed in claim 21, wherein:

said control means includes means for deactivating the temperature modifying apparatus for a minimum off time if the duty cycle factor indicates the temperature modifying apparatus is to be on for more than the predetermined interval of time less the minimum off time.

35. The apparatus for thermostatic control of a temperature modifying apparatus as claimed in claim 34, wherein:

said minimum off time is twenty percent of said predetermined interval of time.

36. The apparatus for thermostatic control of a temperature modifying apparatus as claimed in claim 21, wherein:

said control means includes means for activating said temperature modifying apparatus, repeatedly measuring said ambient temperature and calculating a new duty cycle factor until said new duty cycle factor is less than 100%, thereafter deactivating said temperature modifying apparatus, repeatedly measuring said ambient temperature until the direction of motion of the temperature changes, and thereafter calculating a new duty cycle factor and activating the temperature modifying apparatus for a portion of the next predetermined interval of time corresponding to said new duty cycle factor, whenever said new duty cycle is calculated to be greater than or equal to 100%.

37. The apparatus for thermostatic control of a temperature modifying apparatus as claimed in claim 36, wherein:

said adjustment quantity adjustment means includes means for increasing said adjustment quantity in increments of 5% of B for each predetermined interval of time which passes while said temperature modifying apparatus is activated whenever said new duty cycle is calculated to be greater than or equal to 100%.

38. The apparatus for thermostatic control of a temperature modifying apparatus as claimed in claim 21, wherein:

said control means includes means for activating the temperature modifying apparatus for a period of time related to said new duty cycle factor and deactivating the temperature modifying apparatus for the remainder of the predetermined interval of time.

* * * * *

UNITED STATES PATENT AND TRADEMARK OFFICE

CERTIFICATE OF CORRECTION

PATENT NO. : 4,759,498

DATED : July 26, 1988

INVENTOR(S) : Levine et al

It is certified that error appears in the above-identified patent and that said Letters Patent is hereby corrected as shown below:

Column 1, line 33, "include" should be --includes--.

Column 3, line 38, "is" should be --in--.

Column 3, line 50, delete "The"; "such" should be --Such--.

Column 7, line 3, "discharge" should be --discharges--.

Column 7, line 14, "though" should be --through--.

Column 7, line 53, "osciallator" should be --oscillator--.

Column 11, line 20, "enter" should be --enters--.

Column 11, line 67, "that" should be --than--.

Column 13, line 15, "$S(T_D-T_A)$ should be --$S*(T_D-T_A)$

Column 13, line 20, $S*T_D-T_A)$ should be --$S*(T_D-T_A)$

UNITED STATES PATENT AND TRADEMARK OFFICE

CERTIFICATE OF CORRECTION

PATENT NO. : 4,759,498

DATED : July 26, 1988

INVENTOR(S) : Levine et al

It is certified that error appears in the above-identified patent and that said Letters Patent is hereby corrected as shown below:

Column 13, line 45, "duty factor" should be --duty cycle factor--.

Signed and Sealed this

Fourteenth Day of February, 1989

*Attest:*

DONALD J. QUIGG

*Attesting Officer*

*Commissioner of Patents and Trademarks*